United States Patent [19]

Strother et al.

[11] Patent Number: 4,723,342

[45] Date of Patent: Feb. 9, 1988

[54] LINTER GIN HAVING IMPROVED MOTING SYSTEM

[75] Inventors: Fleetwood E. Strother, Montgomery; Joseph C. Andrews, Prattville, both of Ala.

[73] Assignee: Continental Eagle Corporation, Prattville, Ala.

[21] Appl. No.: 916,781

[22] Filed: Oct. 7, 1986

[51] Int. Cl.[4] ..... D01B 1/08

[52] U.S. Cl. ..... 19/40; 19/58

[58] Field of Search ..... 19/40, 55 R, 58, 60

[56] References Cited

U.S. PATENT DOCUMENTS

| | | | |
|---|---|---|---|
| 16,488 | 1/1857 | Keith | 19/60 X |
| 239,715 | 4/1881 | Brown | 19/58 |
| 244,549 | 7/1881 | Clark | 19/58 |
| 1,237,985 | 8/1917 | Westbrook | 19/58 |
| 1,460,220 | 6/1923 | Allen | 19/60 |
| 2,244,542 | 6/1941 | Morgan | 19/55 R |

*Primary Examiner*—Louis K. Rimrodt

*Attorney, Agent, or Firm*—Mason, Fenwick & Lawrence

[57] ABSTRACT

A linter gin having improved moting system for achieving higher rates of delinting. The improvement comprising a mote deflector obstacle member spaced slightly from the doffer brush, said member defecting the air current to effect more efficient removal of motes and trash from the lint in the mote chamber.

13 Claims, 2 Drawing Figures

LINTER GIN HAVING IMPROVED MOTING SYSTEM

BACKGROUND AND OBJECTS OF THE INVENTION

The present invention relates in general to cottonseed linters or linter gins, and particularly to a linter gin having an improved moting system for achieving higher rates of delinting.

A large variety of designs of linter gins have been proposed or produced for removing lint or linters from cottonseeds which have already been processed in conventional saw gins to remove the long, staple fibers from the seeds. The seed cotton which goes from the field to a cotton gin for ginning, which is commonly termed seed cotton, will produce, when subjected to conventional ginning, a bale of several hundred pounds of lint cotton, for example, a five hundred pound bale, while the remaining cottonseed will have a residue of lint thereon which when removed is known as "cotton linters".

It is common practice to remove the residue lint from the cottonseed which has been processed in a conventional saw gin by passing it through one or more linters, or designing a single linter, to produce for example a first cut lint and a second cut lint, although care must be taken that, in the second cut linter operation, one avoids cutting off some of the hull from the seed and sawing through certain of the seeds to the full extent possible.

The lint or linters removed from the seed in the linter gin by this operation is, of course, one of the salable products procued. The value or price of linters is determined by the percent of foreign matter and therefore it is desirable to remove the trash from the lint in the linter gin.

In the usual slow speed linter gin, "moting" or the removal of trash from the lint was dependent only upon centrifugal force and gravity, causing the heavier or more dense trash to fall out of the air stream created by the brush. It was found that with the higher volume of lint and foreign matter produced by linters incorporating the recent improvements in the feed mechanism and increase in speed of the saw and brush of the gin, the old type moting was not adequate to produce salable lint.

In the usual linter gin, the lint is removed from the seed by the bank of toothed saw blades passing between ribs, and the lint is doffed from the saw teeth by a revolving brush cylinder, where the lint and trash is suspended in the air stream created by the brush cylinder. While there will be some spreading or flarring of the air stream with the lint and trash suspended as it is doffed from the saw by the brush, it has been found by observation that the primary air current continues to follow the circumference of the brush through the moting chamber and into the discharge duct, resulting in very poor moting or removable of trash in the moting chamber.

An object of the present invention is the provision of the linter gin with an improved moting system which effects much higher rate of delinting with linter gins having current improvements in feeding mechanisms and increase in the speed of the saw and brush of the linter gin. Another object of the present invention is the provision of an improved moting system for linter gins, wherein an obstacle is placed close to the parameter of the brush in such a manner that the air current transporting the lint and the trash will be moved away from the brush to disrupt the primary air current following the circumference of the brush and more efficient remove motes and trash from the lint in the mote chamber.

Other objects, advantages and capabilities of the present invention will become apparent from the following detailed description, taken in conjunction with the accompanying drawings illustrating a preferred embodiment of the invention.

DETAILED DESCRIPTION OF THE PREFERRED EMBODIMENT

Figure 1:
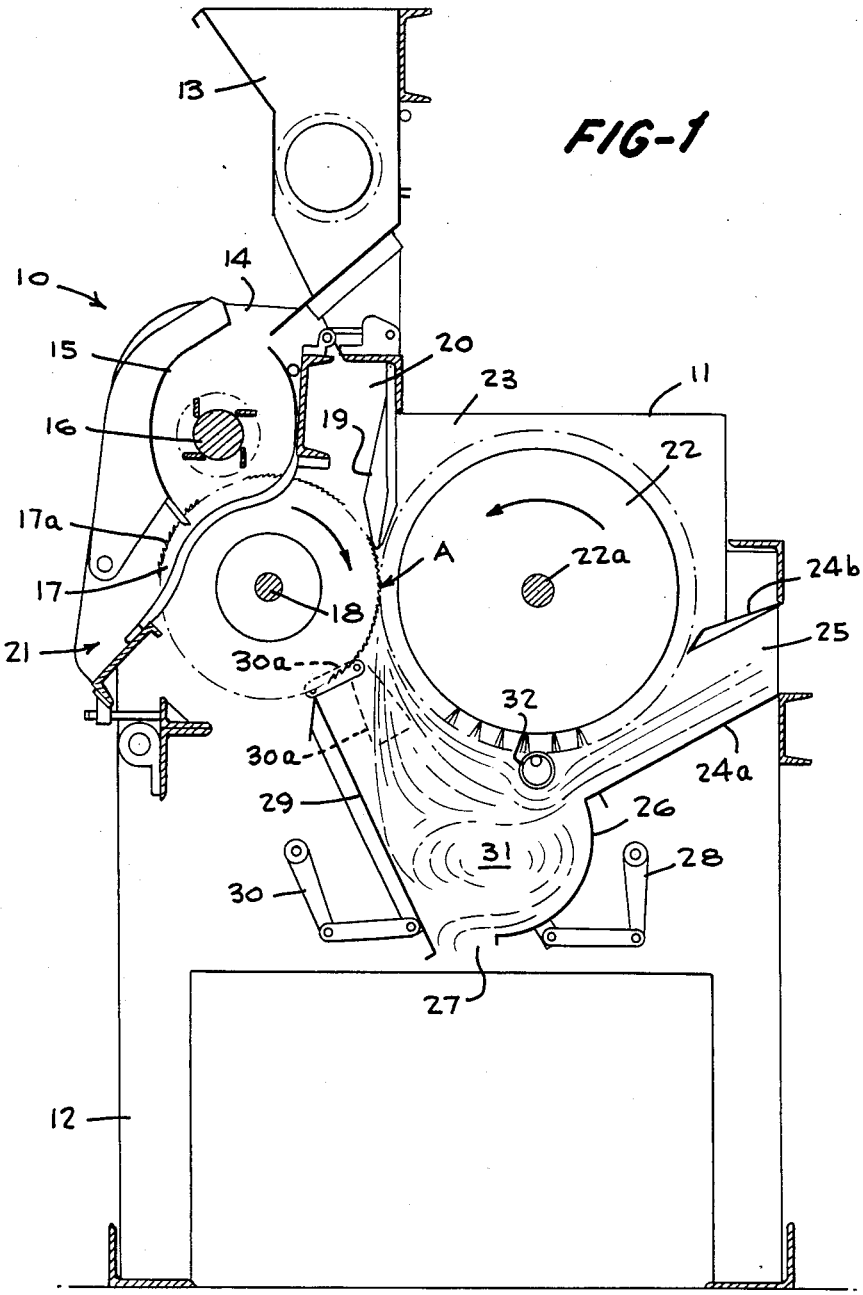
FIG. 1 is a fragmentary diagramatic front-to rear section through a linter gin embodying the present invention.
Figure 2:
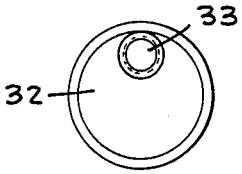
FIG. 2 is an end elevational view, to an enlarged scale, of the adjustable moting bar cylinder of the present invention providing the obstacle to disrupt the primary air current following the circumference of the doffing brush.

Referring to the drawings, wherein like reference character designated corresponding parts throughout the several figures, there is disclosed the linter gin of the present invention, indicated generally by the reference character 10 comprising an elongated housing 11 closed at both ends by end plates (not shown) which carry bearings for the ends of the shafts of the inner rotating components of the linter gin, all supported by vertical upright frame members 12. The linter gin includes a feeder 13 of conventional construction which discharges the cottonseed into the upper feed opening 14 of the roll box 15 having the usual driven rotatable float 16 which works in the roll box 15. The bank of toothed saw blades **17*a* of the rotatable saw cylinder 17 rotatable on its shaft 18 journaled in fixed bearings on the ends of the frame or housing coact with the usual gin ribs 19 to remove the lint from the seed as the lint on the seed is caught by the saw teeth and carried forward into the saw chamber portion 20, while the seed from which the lint has been removed, which is restrained by the gin ribs 19, is discharged by gravity through the seed outlet chute 21**.

The saw, which as viewed in FIG. 1 rotates in a clockwise direction, carries forward the cotton and motes with the saw teeth, passing through the saw chamber 19 down to the point of engagement between the saw 17 and the revolving brush cylinder doffer 22, which constitutes the location of coaction between the saw and brush to effect the doffing and moting operations. The brush cylinder doffer 22 has a counterclockwise rotation, as viewed in FIG. 1, and air currents in what is referred to as the brush chamber 23 set up by the rotation of the brush 22 are directed and deflected downwardly so as to have the proper tangient direction of flow when they enter the throat between the brush 22 and saw elements **17*a*. The linter gin also includes a bottom sheet 24*a* and a top sheet 24*b* defining a discharge duct 25 therebetween and a curved mote board 26 extends downwardly from the lower edge of the inclined bottom sheet 24*a* defining at its lower edge, one edge of an adjustable air entrance gap 27. The mote board is adjustable by an externally accessible and operative lever mechanism 28 for purposes later to be described. A draft shield 29 also extends downwardly from adjacent the perimeter of the saw cylinder 17 below the position of coaction A between the saw 17** and brush 22 and has a lower edge defining the other edge of the adjustable air entrance gap 27, the draft shield adjustment being achieved by adjustment of an externally accessible lever mechanism 30. This lever mechanism also includes a component 30*a* for adjusting the top of the draft shield.

In order to efficiently remove motes and trash from the lint in the mote chamber 31 below the doffer brush 22, we place an obstacle close to the perimeter of the brush 22 adjacent the lowermost portion of the circular path traced by the perimeter of the brush, to disrupt the primary air current following the circumference of the brush 22 in such a manner that the air current transporting the lint and trash will be moved away from the brush 22. This obstacle, which we term a moting bar cylinder, is indicated by the referenced character 32, and can be of many shapes or forms, but in the preferred embodiment of this application, we have used a round cylinder approximately 1¾ inch in diameter, running parallel to the brush shaft 22*a* for the full length of the brush cylinder 22. As the air current transporting the lint and trash comes in contact with this moting bar 32 it is deflected downwardly and around the bar. Since the trash is heavier and more dense than the lint, centrifugal force will move the trash and so forth to the outer edge of the air stream and as the trash passed under the moting bar it will be deflected downward bringing it in contact with the curved surface of the mote board 26 below the top corner formed by the mote board 26 and the bottom sheet 24*a* of the discharge duct 25. As the primary air current passes under the moting bar 32, it moves back to the circumference of the brush 22 carrying the lighter, clean lint into the discharge duct 25 with the trash and motes and some lint being retained in the moting chamber 31. Because of the curvature of the mote board 26, the trash and lint will move in a clockwise rotation, while the primary air current continues to move counter-clockwise. This clockwise rotation will continue until the trash and lint comes in contact with the face of the draft shield 29 at its lower edge. The gap 27 between the lower tip of the mote board 26 and the lower edge of the draft shield 29 is adjustable and a current of air is allowed to enter the mote chamber 31 through this gap 27. This flow of air will be maintained by a negative pressure in the discharge duct 25. The velocity of the air stream in the gap 27 is controlled by adjusting the width of the gap. This velocity will not be sufficient to float the heavier trash but sufficient to float any lint that has been brought into the moting chamber 31. This lint will move in an upward direction along the face of the draft shield and re-enter the primary air current below the moting bar, while the heavier trash and motes are discharged by gravity through the gap 32.

In the slow speed linter it was customary to place the upper tip of the draft shield 29 as high as possible in the V or location of coaction A formed by the circumference of the saw 17 and brush 25 at the doffing point A. This was done in an effort to minimize and control the air current created by the brush cylinder 22 in the moting chamber 31. In the high speed linter, it became obvious that the draft shield 29 in this position would not allow the brush 22 to completely doff the saw 17, whereby some lint and trash followed the saw 17 past the doffing point A, and this lint and trash was usually discharged from the saw 17 at the front of the linter, and accumulated in the bottom of the ribs 19, on the backside of the rib rails and mounting brackets, causing a definite fire hazard as well as a maintenance clean-up problem along with the loss of salable lint.

Due to wear it is necessary to sharpen the delinter saw 17 periodically. This is usually done every 24 hours of operation. As the saw 17 is sharpened the diameter will be reduced. In order to accommodate this change in diameter, it is necessary that the brush cylinder 22 be adjusted with movement toward the saw 17. These changes in the saw and brush also make it necessary that the draft shield 29 be adjustable. This adjustment is accomplished on the outside of the machine by lever 30 at the bottom of the draft shield and 30*a* at the top of the draft shield. This will also make it necessary to re-adjust the mote board 26. This is accomplished from outside the machine by lever mechanism 28. As the brush cylinder 22 moves toward the saw 17 it will be necessary to adjust the mote bar 32, as the edge of the mote bar must remain in close proximity to the circumference of the brush. This is accomplished by mounting the mote bar eccentrically at each end by the eccentric shaft ends, one of which is shown at 33.

We claim:

1. In linter gin comprising a machine frame having a pair of opposite ends, a rotatable saw cylinder journaled in said opposite ends, means for directing cottonseed downwardly to said saw cylinder, a set of gin ribs through which saw elements of the saw cylinder project to remove the lint from the seed as the lint on the seed is caught by the saw teeth and carried forward to the gin ribs, a revolving doffer brush rotatably support at opposite ends at said ends of the machine frame having a transfer position of coaction between the saw and brush spaced a short distance below the gin ribs, a moting chamber under and extending downwardly from a lower portion of the doffer brush for receiving air current from the region of said position of coaction between the saw cylinder and doffing brush to receive lint, motes and trash suspended in the air stream formed therein by the brush cylinder; the improvement comprising primary air current disruptor means spaced close to but non-contacting in relation to the doffer brush in the form of a mote deflector obstacle member having its upper surface set in close proximity to the bottom of the revolving doffing brush spaced slightly from the brush and allowing only running clearance between the brush and the obstacle member, the obstacle member extending longitudinally parallel to the brush and supported at each end of said machine frame to deflect the air current created by the brush following the lower circumferencial path of the brush periphery as well as the lint, motes and trash being transported in the air stream formed in the mote chamber to change the direction of said air current by defecting it downwardly and around the obstacle member and effect more efficient removable of motes and trash from the lint in the mote chamber through a discharged duct extending from an entrance immediately below the doffing brush in a substantially opposite direction from said obstacle member relative to the saw cylinder.

2. In a linter gin as described in claim 1 said obstacle member comprising a mote bar forming a mote deflector which is mounted eccentrically at opposite ends in order that the moting bar is adjustable as the brush is relocated due to wear and sharpening of the saw cylinder saw elements and the like whereby only running clearance is maintained between the brush and the moting bar.

3. In a linter gin as described in claim 2 wherein said mote bar comprising a cylindrical member of coextensive axial linked with the doffing brush having a pair of eccentric stub shaft projections at the opposite ends thereof mounted in the machine frame ends for adjusted of the cylindric portion thereof.

4. A linter gin as defined in claim 2, including an adjustable draft shield forming a front wall of the moting chamber having an upper edge and adjustment means associated therewith accessible from the exterior of the linter gin for adjusting the upper edge of the draft shield and very close proximity to the cylindric saw wall forward of the doffing point formed at said point of coaction and located approximately under the center of the saw cylinder, a draft shield extending longitudinally to each end of the vane frame and having a lower horizontal edge which forms the front edge of an air gap at the bottom of said mote chamber allowing air to be drawn into the mote chamber, the lower edge of the draft shield being adjustable horizontally in either direction independent of adjustment of the upper end of the draft shield.

5. In a linter gin as described in claim 4 said obstacle member comprising a mote bar forming a mote deflector which is mounted eccentrically at opposite ends in order that the moting bar is adjustable as the brush is relocated due to wear and sharpening of the saw cylinder saw elements and the like whereby only running clearance is maintained between the brush and the moting bar.

6. A linter gin as defined in claim 2, wherein a front wall of the linter gin extends between said ends of the main frame and forms a draft shield, the linter gin having a rear wall formed by a curved mote board, the upper corner or edge of the mote board being supported by adjusted means for adjusting the upper corner or edge of the mote board along the path of a bottom sheet of the discharge duct causing the mote board to pivot about its upper most corner and allowing a bottom edge of the mote board which forms the rear wall of said air gap at the bottom of the mote chamber so moves horizontally in either direction.

7. A linter gin as defined in claim 6, wherein said draft shield and curved mote board form the moting chamber with the adjustable air gap at its lower extremity for entrance of an air stream, the velocity of the air stream being raised or lowered by increasing or decreasing the width of the air gap, the air stream having a portion moving with the motes and trash in a clockwise direction passing the material across the bottom of the mote chamber above the air gap, and the width of the air gap being adjusted to maintain the velocity of the incoming air below the floating velocity of the trash and motes so that the trash and motes are discharged by gravity through the air gap in the lower portion of the mote chamber and the floating velocity of clean lint being much lower than the floating velocity of the motes or trash whereby the clean lint will move in an upward clockwise direction reentering the main air stream below the mote bar.

8. A linter gin as defined in claim 2, wherein the linter gin includes a draft shield forming a front wall of a mote chamber and a curved mote board forms a rear wall of the mote chamber, the draft shield and mote board defining an adjustable air gap at the lower extremity of each for the entrance of an air stream into the mote chamber, the velocity of the air stream being raised or lowered by increasing or decreasing the width of the air gap, the air stream having a portion moving with the motes and trash in a clockwise direction passing the material across the bottom of the mote chamber above the air gap, and the width of the air gap being adjusted to maintain the velocity of the incoming air below the floating velocity of the trash and motes so that the trash and motes are discharged by gravity through the air gap in the lower portion of the mote chamber and the floating velocity of clean lint being much lower than the floating velocity of the motes or trash whereby the clean lint will move in an upward clockwise direction reentering the main air stream below the mote bar.

9. A linter gin as defined in claim 1, including an adjustable draft shield forming a front wall of the moting chamber having an upper edge and adjustment means associated therewith accessible from the exterior of the linter gin for adjusting the upper edge of the draft shield and very close proximity to the cylindric saw well forward of the doffing point formed at said point of coaction and located approximately under the center of the saw cylinder, a draft shield extending longitudinally to each end of the vane frame and having a lower horizontal edge which forms the front edge of an air gap at the bottom of said mote chamber allowing air to be drawn into the mote chamber, the lower edge of the draft shield being adjustable horizontally in either direction independent of adjustment of the upper end of the draft shield.

10. A linter gin as defined in claim 9, wherein a front wall of the linter gin extends between said ends of the main frame and forms a draft shield, the linter gin having a rear wall formed by a curved mote board, the upper corner or edge of the mote board or edge of the mote board along the path of a bottom sheet of the discharge duct causing the mote board to pivot about its upper most corner and allowing a bottom edge of the mote board which forms the rear wall of said air gap at the bottom of the mote chamber so moves horizontally in either direction.

11. A linter gin as defined in claim 1, wherein a front wall of the linter gin extends between said ends of the main frame and forms a draft shield, the linter gin having a rear wall formed by a curved mote board, the upper corner or edge of the mote board being supported by adjusted means for adjusting the upper corner or edge of the mote board along the path of a bottom sheet of the discharge duct causing the mote board to pivot about its upper most corner and allow a bottom edge of the mote board which forms the rear wall of said air gap at the bottom of the mote chamber so moves horizontally in either direction.

12. A linter gin as defined in claim 11, wherein said draft shield and curved mote board form the moting chamber with the adjustable air gap at its lower extremity for entrance of an air stream, the velocity of the air stream being raised or lowered by increasing or decreasing the width of the air gap, the air stream having a portion moving with the motes and trash in a clockwise direction passing the material across the bottom of the mote chamber above the air gap, and the width of the air gap being adjusted to maintain the velocity of the incoming air below the floating velocity of the trash and motes so that the trash and motes are discharged by gravity through the air gap in the lower portion of the mote chamber and the floating velocity of clean lint being much lower than the floating velocity of the motes or trash whereby the clean lint will move in an upward clockwise direction reentering the main air stream below the mote bar.

13. A linter gin as defined in claim 1, wherein the linter gin includes a draft shield forming a front wall of a mote chamber and a curved mote board forms a rear wall of the mote chamber, the draft shield and mote board defining an adjustable air gap at the lower extremity of each for the entrance of an air stream into the mote chamber, the velocity of the air stream being raised or lowered by increasing or decreasing the width of the air gap, the air stream having a portion moving with the motes and trash in a clockwise direction passing the material across the bottom of the mote chamber above the air gap, and the width of the air gap being adjusted to maintain the velocity of the incoming air below the floating velocity of the trash and motes so that the trash and motes are discharged by gravity through the air gap in the lower portion of the mote chamber and the floating velocity of clean lint being much lower than the floating velocity of the motes or trash whereby the clean lint will move in an upward clockwise direction reentering the main air stream below the mote bar.

* * * * *